United States Patent [19]

Winsor

[11] 4,315,552

[45] Feb. 16, 1982

[54] RAISE DRILL APPARATUS

[75] Inventor: Jack O. Winsor, Seattle, Wash.

[73] Assignee: Dresser Industries, Inc., Dallas, Tex.

[21] Appl. No.: 38,754

[22] Filed: May 14, 1979

[51] Int. Cl.[3] ..... B23Q 5/027; B23Q 5/033

[52] U.S. Cl. ..... 173/159; 173/152

[58] Field of Search ..... 173/159, 152; 92/146; 175/53

[56] References Cited

U.S. PATENT DOCUMENTS

| | | | |
|---|---|---|---|
| 2,090,854 | 8/1937 | Timbs | 173/152 |
| 3,220,494 | 11/1965 | Cannon et al. | 175/53 X |
| 3,454,114 | 7/1969 | Poage | 173/152 |
| 3,490,546 | 1/1970 | Hattrup et al. | 173/159 |
| 3,754,605 | 8/1973 | Porter et al. | 173/152 X |
| 3,797,587 | 3/1974 | Klien | 173/152 |
| 3,850,253 | 11/1974 | Lupton et al. | 173/152 |
| 3,857,451 | 12/1974 | Williams | 173/152 |

*Primary Examiner*—Ronald Feldbaum

*Attorney, Agent, or Firm*—John M. Lorenzen

[57] ABSTRACT

A drilling apparatus includes a ground engaging base, a torque transmitting apparatus for engaging and transmitting torque to drill pipe, and hydraulic cylinders connected to the base for moving the torque transmitting apparatus back and forth along the drill pipe axis. The hydraulic cylinders are connected to the base and include open ends facing away from the base. A piston rod is movable in and projects outwardly from the open end of each cylinder. A guide tube surrounds and is connected to the outer end of each piston rod. The guide tubes include inner surface portions which overlap and slidingly engage outer surface portions of the cylinders and the torque transmitting apparatus is connected between the guide tubes.

10 Claims, 6 Drawing Figures

50
22
10
54
56
48
48
44
28
26
30
20
16
18
12
14

RAISE DRILL APPARATUS

BACKGROUND OF THE INVENTION

This invention relates to raise drills and, in particular, to the supporting and guiding structure for raising and lowering the drill head portion of the apparatus. Raise drilling is a term which relates to a technique of boring or reaming large diameter holes which includes drilling a relatively small diameter pilot hole into earth strata until the cutting bit emerges into an open space and then replacing the small cutting bit with a specially-designed large-diameter reamer and cutting the larger hole along the path of the pilot hole by pulling the reamer back toward the drill rig. This technique is well known in the art and many such drill rig apparatuses have been developed.

The subject invention relates to two other applications filed on the same day herewith, namely Ser. No. 38,955, which is now U.S. Pat. No. 4,214,445 and entitled "Hydraulic Circuitry for Raise Drill Apparatus", and Ser. No. 38,753 which is entitled "Chuck and Wrench Assembly for Raise Drill Apparatus".

Most such drill rigs utilize hydraulic thrust cylinders for raising and lowering a drill head which itself is rotated by means of an electric or hydraulic motor. Such apparatuses are relatively heavy and utilize high drive torque for the drill head. Two or more hydraulic thrust cylinders are normally used, one located in a balanced geometry around the drill head, and separate guide columns are provided for guiding the up and down movement of the drill head and associated hardware and resisting reactive torque transmitted from the drill head. These guide columns are in all known cases, provided with structural cross-ties at both the top and bottom of the machine for additional torsional stiffness.

One known prior art drill rig manufactured by the Subterranean Division of Kennametal has a pair of cylinders connected to the machine base and a cross-frame mounted for up and down movement around the outer surface of the cylinders. The pistons are connected to the cross-frame through a pair of open channels located around but not engaging the cylinders, the channels and cylinders both being structurally tied at their upper ends through cross-ties or connecting beams.

It has been found that these types of support structures have added to the weight and cost of raise drills. The existence of structural cross-ties and additional support structures have further required special design considerations to allow accessibility for assembly, maintenance and operation.

SUMMARY OF THE INVENTION

In accordance with the invention, the problems discussed above have been solved by a design which eliminates the separate guide and support columns and structural cross-ties. Instead, the thrust cylinders themselves are designed to operate as the only necessary guide and support structure, eliminating the additional guide column and cross-tie structure of prior art machines.

The cylinders are connected to the base of the machine, each cylinder including an open end facing away from the base. A piston rod is movable in each cylinder with a guide tube connected at the upper end of the rod and surrounding the rod and cylinder. The guide tube is cylindrical in shape, the inside surface of the lower portion of each guide tube slidingly engaging the outer surface of a cylinder through a bronze sleeve. The drill head and associated hardware are connected between the guide tubes and move up and down along with the guide tubes.

By utilizing the thrust cylinders to guide and support the drill head and torque producing hardware and provide the necessary structural stiffness, expensive and space-restrictive cross-ties and supplemental guide and support members are eliminated. This unique design reduces structural complexity as well as production costs because of fewer parts and less specialized machining and welding procedures.

BRIEF DESCRIPTION OF THE DRAWINGS

These and other objects and advantages of the invention will become more apparent when the detailed description of preferred embodiments set forth below is considered in conjunction with the accompanying drawings, in which.

DETAILED DESCRIPTION OF PREFERRED EMBODIMENTS

Figure 1:
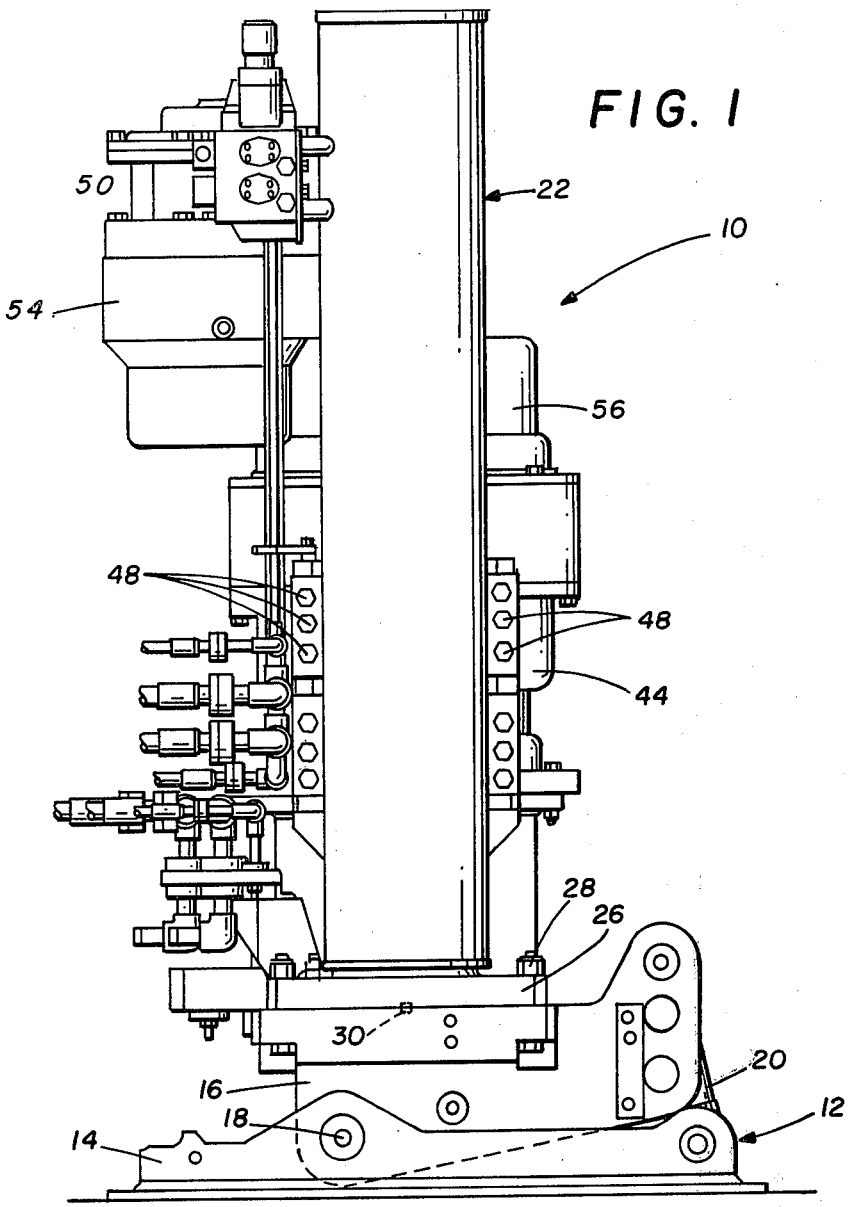
FIG. 1 is a side plan view of a raise drill apparatus designed in accordance with the invention.

Referring now to FIGS. 1–4, a raise drill apparatus designed in accordance with the invention will be described, which is designated generally by reference numeral 10. The raise drill 10 includes a base 12 which, as shown best in FIG. 2, can be formed of a pair of mounting pads 14 which are anchored to the ground surface by suitable bolts (not shown). A work table 16 is connected to the base 12 through pivot pins 18 which allow the work table 16 and other structure described below to be tilted by means of a pair of turnbuckles 20 which connect the front portion of the work table 16 to the mounting pads 14 so that the raise drill apparatus can be selectively tilted for drilling holes through a range of angular orientations relative to the ground surface.

At least two thrust cylinders and guide tube configurations generally designated by reference numeral 22 are connected to the work table 16 and operated to provide the necessary axial force required for the drilling operation and at the same time guide the drilling mechanism along an accurate path and absorb reaction torque. The thrust cylinder and guide column configuration 22 include a hydraulic cylinder 24, as best shown in FIG. 4, which includes a plate 26 that is held in place by bolts 28 on the work table 16 and a key 30 positioned in matching slots 31 located in abutting surfaces of the plate 26 and work table 16.

A piston rod 32 is slidingly movable within the cylinder 24 by appropriate hydraulic means which will be described in greater detail below. The piston rod and cylinder operate to provide the axial force necessary to perform the drilling operation. The necessary support and guiding function is accomplished by means of a guide tube 34 which is connected at its top end to the outer end of the piston rod 32 through a plurality of bolts (not shown) which project through the top of the guide tube 34. A cap 36 is provided to keep dirt and moisture from entering the guide tube 34 and thrust cylinder configuration. The guide tube 34 engages the outer surface of the hydraulic cylinder 24 through a bronze bushing 38 fixed on the inner surface of the guide tube 34 for providing a tight minimal-friction fit between the guide tube 34 and hydraulic cylinder 24.

Figure 4:
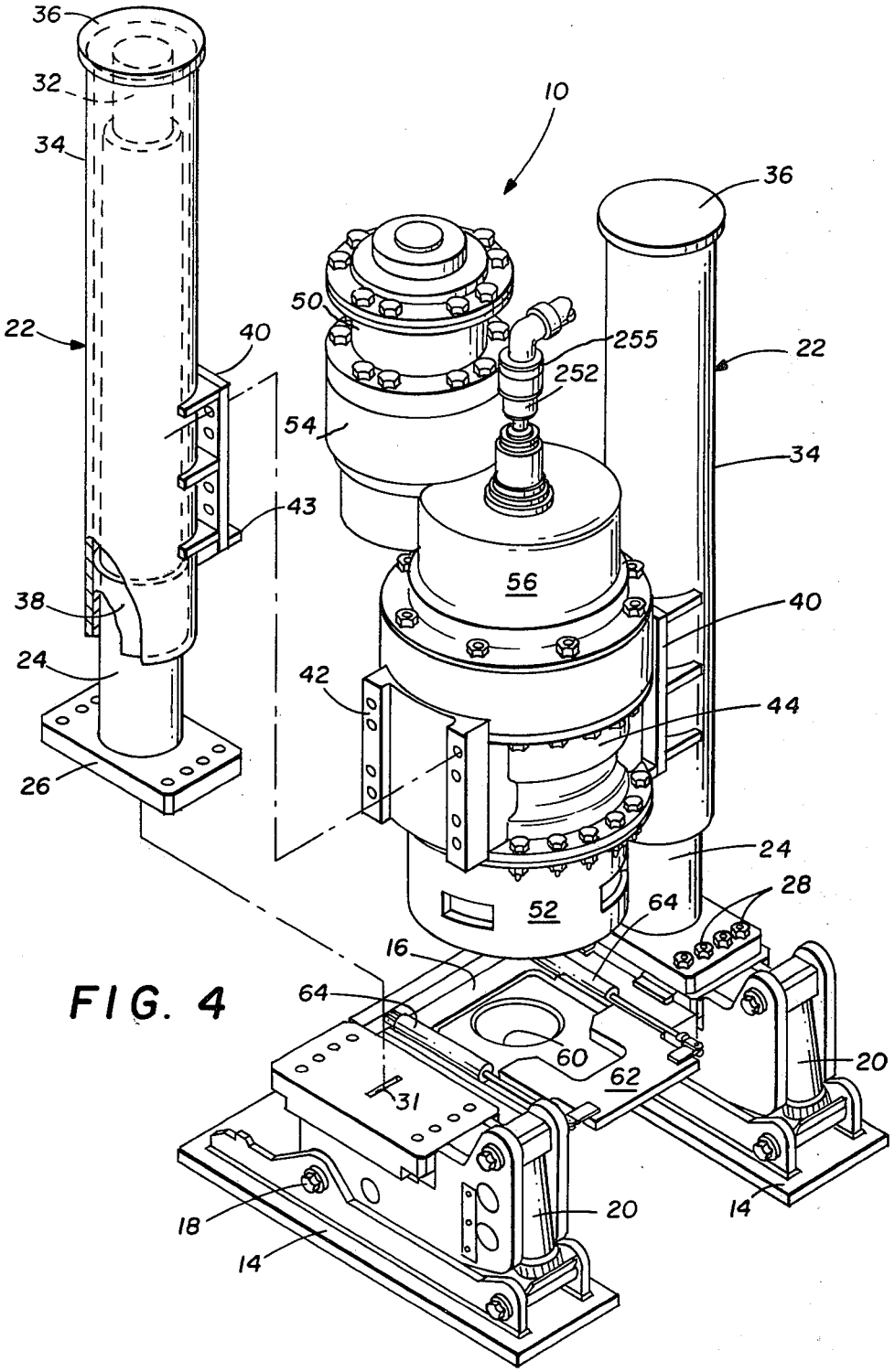
FIG. 4 is a schematic view of the apparatus of FIGS. 1–3, with one of the combined thrust cylinder and guide column configurations disassembled from the remainder of the apparatus for showing details of the interconnection.

The mechanism which performs the torque transmitting function of the raise drill apparatus 10 is mounted between the guide tubes 34 as shown best in FIG. 4. A support bracket 40 is welded or otherwise rigidly connected to the outer surface of each guide tube 34. The two support brackets 40 face each other with enough space between them to receive the torque transmitting mechanism. A second pair of support brackets 42 designed to mate with the support brackets 40 are welded or otherwise rigidly connected to the outer surface of a casing for the transmission 44. The brackets 40 and 42 are connected by a plurality of bolts 48 for supporting the torque transmitting mechanism of the apparatus, which in addition to the transmission 44 includes a motor 50, a chuck assembly 52, and a series of gear reducers 54 and 56.

Figure 2:
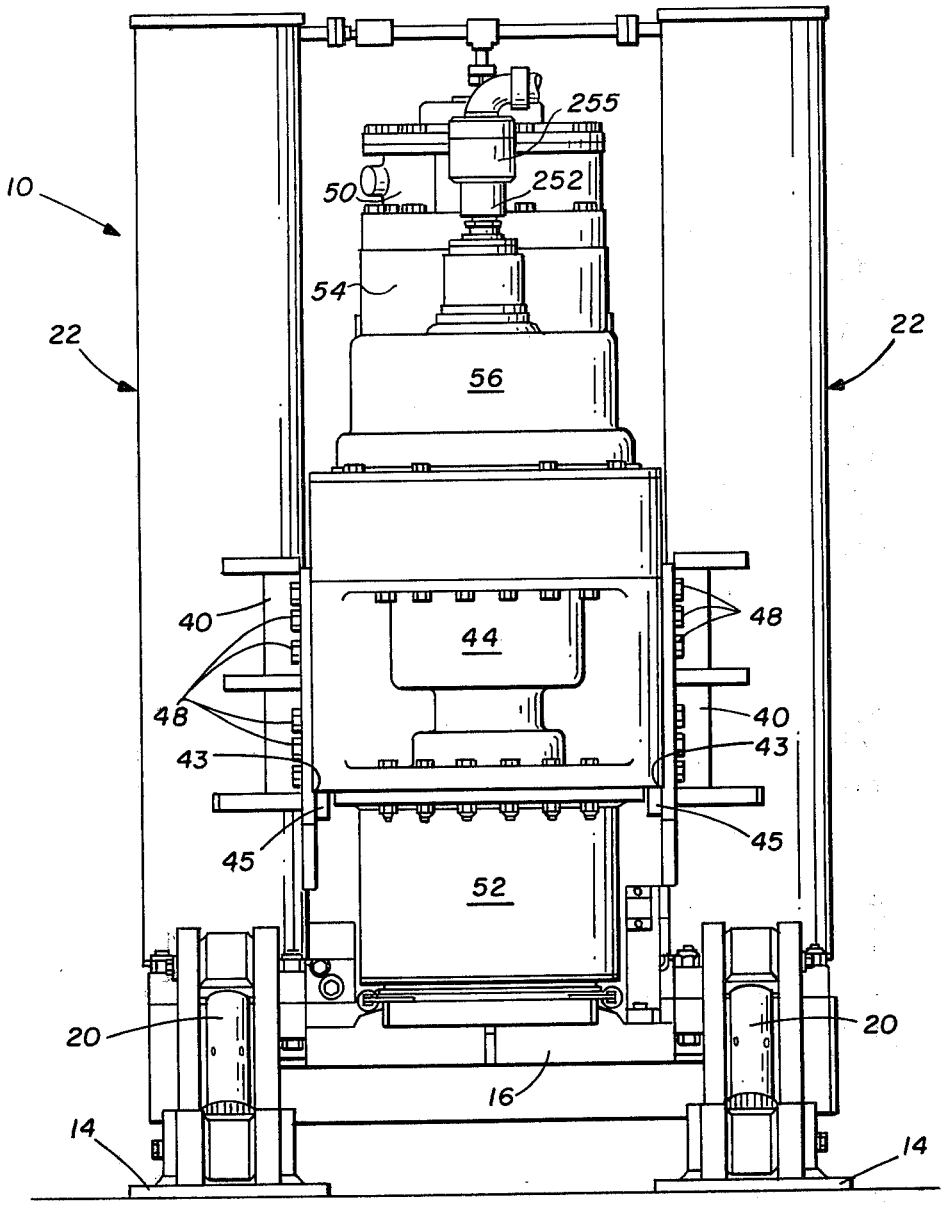
FIG. 2 is a front plan view of the apparatus of FIG. 1.

As shown in FIG. 2, the brackets 40 each include a ledge 43 along the lower portion of its outer surface which cooperates with a shear block 45 welded to the bracket 40 to form an extension of the ledge for supporting the torque transmitting apparatus and relieving shear stress from the bolts 48. Alternatively, keys and key slots (not shown) can be provided.

As will become more apparent from the following detailed description, the chuck 52 operates to engage the uppermost end of one or more drill pipe sections through mating threads (not shown) of standard size and shape. The drill pipe sections will project through a central opening 60 in the work table 16 and into the underlying ground. In operation, a pilot hole of 10–14 inches in diameter is first drilled downwardly through the earth strata. The chuck 52 engages the uppermost end of a drill pipe section which has a drill bit (not shown) on the other end. The thrust cylinders 22 will provide sufficient downward force as the motor 50 operates to rotate the drill pipe for drilling the pilot hole.

When the thrust cylinders 22 reach the lower limit of their stroke range, a sliding fork 62 mounted on the work table 16 will be moved against the drill pipe by means of hydraulic cylinders 64 and will engage several depressions or flats located around the outer surface of the drill pipe in a way which is well known in the art. The fork 62 will support the weight of the drill pipe and lock the pipe against rotation while the motor 50 is reversed to unscrew the uppermost end of the drill pipe from the chuck. The thrust cylinders 22 are then reversed for raising the chuck 52 so that another section of drill pipe can be moved into position by a standard pipe handling mechanism (not shown) for engagement with the chuck 52 and pipe section held by the fork. The pipe handling mechanism will operate to loosely engage the mating screw threads between the new pipe section and the chuck and existing pipe section, the motor 50 again being reversed to tighten the joints. The combined actions of the thrust cylinders 22 and rotating apparatus will repeat the operations described above until the pilot hole is completed.

When the pilot hole intersects a mine passageway, the initial drill bit is removed and replaced by a larger raise drill reaming bit which can range from five feet to over twenty feet in diameter. The reamer is simultaneously rotated and raised along the pilot hole to form a relatively large diameter shaft.

For one embodiment of the invention, the motor 50 can be a two-speed hydraulic motor of the type manufactured by Poclain, Model No. H30-4400, which generates 300 horsepower at 105 r.p.m. (135 r.p.m. maximum) rotational speed.

The drilling speed can be up to 92 r.p.m. and the reaming speed up to 14.4 r.p.m. A continuous drive torque of 130,200 lb.-ft. can be supplied, stall torque being 173,600 lb.-ft. at 5,800 p.s.i. The connecting gears between the motor 50 and chuck 52 can include the first gear reducer 54 including a 1.47 pinion and gear ratio and the second gear reducer including 6.4 planetary gear ratio, the ream ratio being 9.4:1. A normal pilot drill thrust of 103,000 lbs. (241,906 max. at 3,500 p.s.i.) and a remaining thrust of 905,000 lbs. at 4,500 p.s.i. can be provided.

Figure 5:
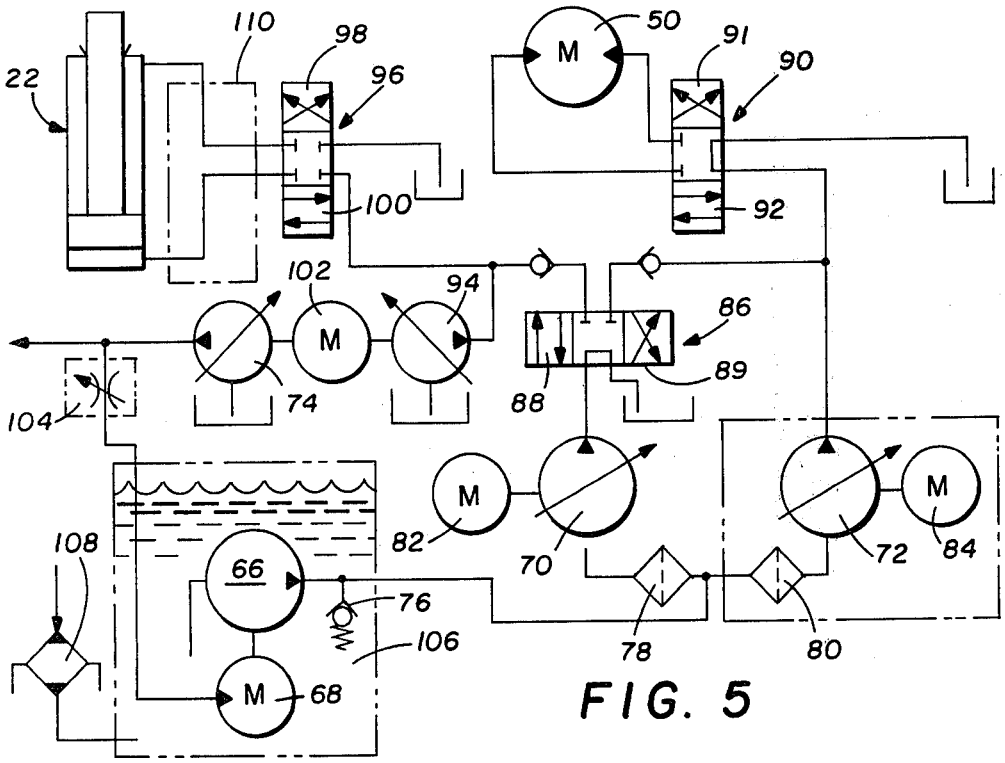
FIG. 5 is a schematic view of the hydraulic system used to operate the raise drill apparatus.

The raise drill apparatus is operated by a hydraulic system, the components of which are shown in detail in FIG. 5 where reference number 66 is used to designate a charge pump which is driven by a charge pump motor 68 and supplied hydraulic fluid to inlets of drive thrust pump 70 and rotation pump 72. The charge pump motor 68 is driven by a pump 74.

Charge pump 66 supplies oil to pumps 70 and 72 at a slightly greater flow rate than required with excess oil being discharged through a pressure relief valve 76 which is set at about 15 p.s.i.g. This feature provides enough hydraulic pressure to overcome losses caused by filters 78 and 80 and internal line losses so that a positive pressure at the inlets to pumps 70 and 72 is maintained. The pump 70 is driven by a motor 82 and pump 72 by a motor 84, both of which may be mechanically or electrically driven.

The pump 72 drives the main drive motor 50 while the pump 70 operates the thrust cylinders 22 during their rapid movement phase while drill pipe is being added or removed and assists the pump 72 in driving the motor 50 during drilling or reaming. A valve 86 which can be set in its rapid-traverse mode 88 or switched to its main drive mode 89 controls the output of the pump 70 to perform these operations. A valve 90 controls the output from the pump 70 and/or the pump 72 to the motor 50 through its forward and reverse modes 91 and 92, respectively.

During normal pilot hole drilling or raise hole reaming operations when the pump 70 is assisting the pump 72 in driving the motor 50, a pump 94 supplies hydraulic fluid to the thrust cylinders 22 through a cylinder control valve 96 which controls the thrust cylinders 22 through raising and lowering modes 98 and 100, respectively. A motor 102 charges the pump 94 as well as the pump 74. As mentioned above, the pump 74 drives the motor 68. In addition, the pump 74 can operate auxiliary hydraulic circuits for a drill pipe handling mechanism, the transmission shifting cylinder, a lubrication pump, and the pistons which operate the fork 62. A pressure compensated flow control or metering device 104 can be located in the line between the pump 74 and the motor 68 for controlling the motor speed of the charge pump 66. A sump 106 receives return fluid from the hydraulic circuits, a heat exchanger 108 being provided for cooling all return fluid. A regeneration valve shown schematically and designated by reference numeral 110 can be provided for selectively connecting the thrust cylinder inlet ports to the outlet ports for increasing traverse speed when drill pipe sections are being added or removed. It is understood that other components such as cylinder relief valves, counterbalance valves, etc., commonly known to those skilled in the art, may be incorporated in the design but are omitted from this application for simplicity.

Figure 6:
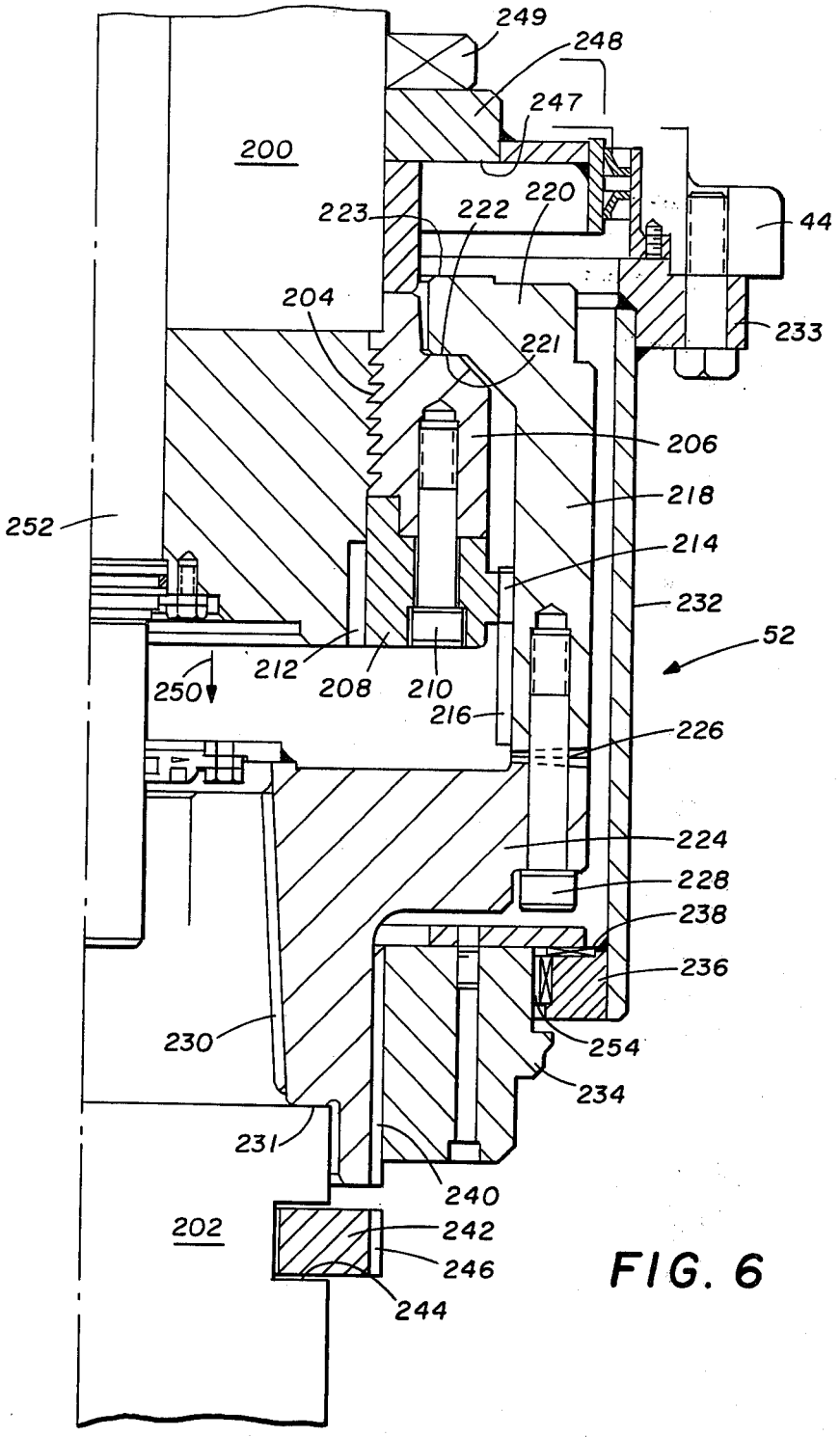
FIG. 6 is a cross-sectional view of the right half of the chuck and wrench portions of the apparatus.

In order to engage and transmit torque to the drill pipe and at the same time provide the necessary operational function for removing or adding drill pipe sections, the chuck mechanism 44 shown in detail in FIG. 6 has been provided. The chuck 52 operates to transmit torque from an output shaft 200 of the transmission 58 to a section of drill pipe 202. The drive shaft 200 has a threaded lower portion 204 which engages mating threads of a thrust nut 206. A lower thrust nut section 208 is connected to the upper section 206 by bolts 210 and is fixed to rotate with the shaft 200 through engaging splines 212 and functions to retain the thrust nut 206 in place and prevent it from becoming disengaged from the shaft 200.

The outer surface of the lower thrust nut portion 208 includes splines 214 which engages mating splines 216 located on the inner surface of a chuck bell housing 218. The bell housing 218 includes an inwardly projecting flange 220 having a lower surface 221 which engages an upper ledge surface 222 on the thrust nut 206, the function of the mating surfaces being to relieve lateral stress when the drill pipe is deflected a predetermined amount during its reaming operation and to transmit thrust forces from the cylinders to the drill pipe, as is described in greater detail below.

The bell housing 218 is rigidly connected to a chuck 224 through matching face gears 226 and a plurality of bolts 228. The chuck 224 is threaded as designated generally by reference numeral 230 to accommodate mating threads located on the drill pipe section 202.

Each drill pipe section 202 includes an upper end which is threaded as shown in FIG. 6 and a lower end which has internal threads (not shown) for engaging the upper threads on an adjacent pipe section. During the phase of machine operation in the upward reaming process where pipe sections are removed, as described in greater detail below, the chuck rotation is reversed by switching the valve 90 and, while the adjacent pipe section is held against rotation, the uppermost section is uncoupled from the chuck. The threads 230 will loosen before those in the joint between the adjacent pipe sections because the chuck threads are formed of harder metal (with smoother surfaces) than the drill pipe and contact area 231 between the pipe 202 and chuck 224 is smaller than that (not shown) between the adjacent pipe sections. This results in a lower frictional threshold at the chuck connection.

These chuck elements form the drive mechanism for the chuck portion of the apparatus, torque being transmitted from the drive shaft 200 and thrust nut 206 through the lower thrust nut section 208 and splines 214 and 216 to the bell housing 218. The lower chuck 224 is accordingly caused to rotate which in turn rotates the drill pipe 202 through the mating threads 230.

In order to enable the drive mechanism to remove sections of drill pipe during up reaming operations, a wrench mechanism is provided which includes a wrench support tube 232 rigidly connected to the outer surface of the transmission casing 44 through a connecting ring 234. The lower end of the support tube 232 includes an inwardly projecting flange 236 which engages a wrench socket 234 through a bearing 238 which is in the form of a disc formed of a relatively soft metal such as brass impregnated with lubricant, one such element being sold under the name "OILITE".

The wrench socket 234 is connected to the lower chuck 224 through mating splines 240, causing the wrench socket 234 to rotate with the lower chuck while the wrench support tube 232 remains stationary. The wrench socket 234 cooperates with wrench sections 242 which are placed in flats or depressions 244 spaced apart around the outer surface of the drill pipe 202. The wrench sections include outer splines 246 which cooperate with the splines 240 on the wrench socket 234, as described below, and are in the form of two or more semicircular sections which can normally be placed in or removed from the flats 244.

Now, the operation of the chuck and wrench mechanisms will be described. During the pilot hole drilling when the thrust cylinders transmit downward force to a drill bit connected at the end of the drill pipe 202, the bottom surface 247 of a collar 248 will engage the upper surface 223 of the flange 220 after the drive shaft 200 floats downwardly in the direction of an arrow 250, the splines 214 sliding downwardly relative to and along the splines 216. In this position, downward force is transmitted from the gear mechanism through tapered roller bearings 249, collar 248, bell housing 18 and lower chuck 224 to the drill pipe 202 until a new length of drill pipe needs to be added to continue drilling operations. It is contemplated that a drill pipe section will be about five feet long so that a number of sections of drill pipe must be added in order to drill holes which can be as deep as a thousand feet or more.

Figure 3:
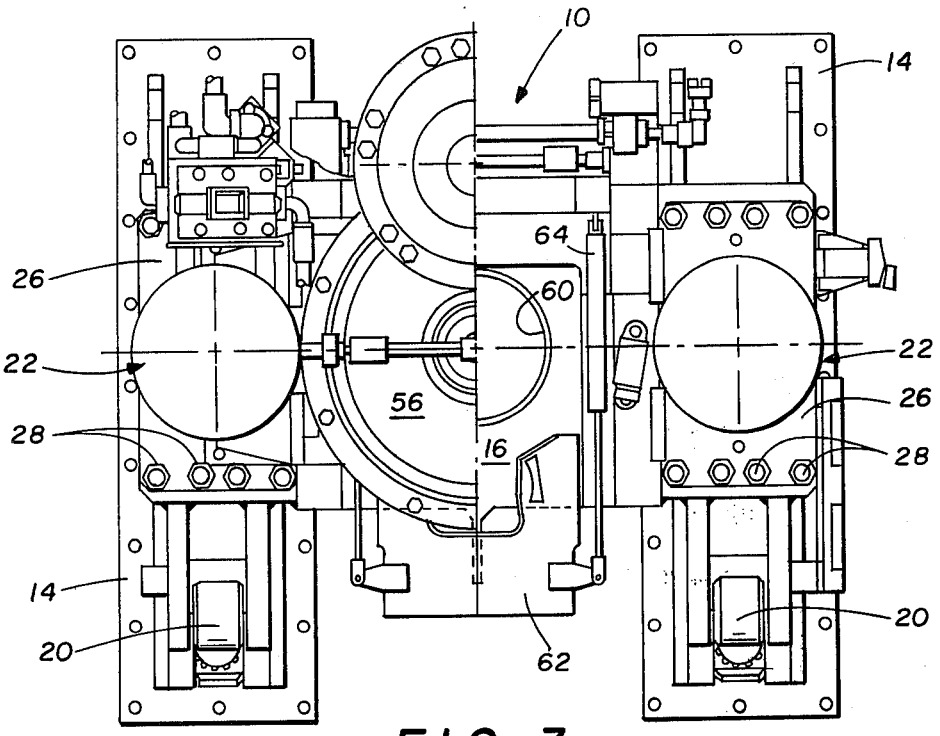
FIG. 3 is a top plan view of the apparatus of FIGS. 1 and 2; see other case

In order to disengage the chuck mechanism from the drill pipe for adding another pipe section, the fork 62 shown in FIG. 3 is actuated by the hydraulic cylinders 64 and pulled toward the drill pipe section 202, engaging the flats 244 for restraining the drill pipe from rotational movement. The motor 50 is reversed and the chuck 224 unscrewed from the drill pipe 202.

The trust cylinders 22 are actuated to raise the chuck mechanism away from the drill pipe by reversing the cylinder control valve 96. As the chuck is raised, the splines 214 will slide upwardly relative to and along the splines 216 until the ledge 222 on the upper surface of the thrust nut 206 engages the lower surface 221 of the flange 220, which operates to raise the chuck 224 away from the drill pipe section 202 a sufficient distance so that another drill pipe section can be added.

The additional section is aligned between the chuck and lower drill pipe section by a mechanism known to the art which will not be described. The valve 90 is actuated to reverse the motor 50 so that the chuck 224 will be rotated in normal clockwise motion for engaging the mating threads 230. The thrust cylinders 22 are then actuated and normal drilling operations are carried out, the drive shaft 200 moving downwardly in the direction of the arrow 250 until the ring 248 engages the upper surface 223 of flange 220 so the downward force can be once again exerted on the drill pipe 202.

After this operation is repeated until the pilot hole has been drilled, the pilot hole cutter bit is then removed and replaced by a large-diameter reaming bit which will be used to form the raised hole. During this drilling operation, a combination of upwardly directed force and torque will be applied to the reamer through the drill pipe sections 202.

After the reaming bit has been raised to the upper limit of movement of the thrust cylinders, a section of drill pipe must be removed in order to continue the operation. When the uppermost drill pipe section 202 is totally above the work table to where the fork 62 can engage the upper flats 244 in the second drill pipe section and prevent it from rotating and for holding the lengths of drill pipe to prevent them from falling. The drive shaft 200 is lowered to where the splines 214 are about in the center of the splines 216.

The motor control valve 90 is then reversed which operates to loosen the threads between the chuck 224 and the pipe section 202; the lower joint will not break because of the lower frictional threshold between the chuck and pipe section as described in detail above. The threads are not totally separated but are maintained loosely joined. The wrench sections 242 are inserted in the flats 244 and the thrust cylinders 24 are once again lowered which causes the drive shaft 200 as well as the wrench support tube 232 and wrench socket 234 to be lowered to where the splines 240 on the inner surface of the wrench socket 234 will engage the splines 246 located around the outer surface of the wrench sections 242.

Since the splines 240 on the wrench socket 234 will also engage cooperating splines located on the outer surface of the lower chuck 224, when the motor 50 is rotated in its counterclockwise direction the drill pipe 202 will rotate along with the chuck 224 even though their mating threads have been loosened because of torque transmitted through the wrench sections 242. This action will loosen the lower tool joint connection between the drill pipe 202 and the second length of pipe, the thrust cylinders raising the upper section out of engagement with the lower one so the pipe engaging mechanism (not shown) can remove the upper pipe section after the wrench sections 242 are taken out of the flats 244. The thrust cylinders 24 are reversed to lower the chuck 224 into engagement with the drill pipe section held by the fork 62, the motor 50 rotating the chuck 224 to engage the threads 230 so that the upward reaming operation can be continued. Thus, with the chuck mechanism described in detail above used in conjunction with the hydraulic circuit shown in FIG. 5 removal or addition of drill pipe sections can be performed quickly and efficiently.

Now, referring again to FIG. 6, a safety feature of the chuck mechanism will be described in detail. During upreaming operations, the reaming bit will travel through rock strata of different hardnesses and consistencies. Occasionally, the bit will be deflected laterally relative to the pilot hole axis which will exert a moment force on the chuck mechanism. If this moment force is totally absorbed by a rigid chuck mechanism the likelihood of failure is great. Therefore, a safety feature has been included in the chuck mechanism which allows internal portions of the chuck to rock when a moment force at a predetermined level is exerted. This rocking action occurs at the engagement surface between the ledge 222 of the thrust nut 206 and its cooperating the lowermost surface 221 of the flange 220. The splines 214 and 216 fit loosely enough to allow a 2° deflection from center, if a lateral force is exerted at some point along the length of drill pipe. A gap designated generally by reference numeral 254 between the wrench socket 234 and retaining ring 236 accommodates the deflection in the lower portion of the wrench engaging mechanism. In this way, if the drill pipe should happen to be deflected beyond the strength threshold of the chuck mechanism, the chuck will tilt enough to absorb the deflection without transmitting a breaking force to any of the chuck components or the shaft 200.

If the drill pipe should tilt beyond a 1° angle, the socket 234 will engage the ring 236, transmitting the moment load through the support tube 232 into the transmission casing 44. Since these components can absorb greater loads than the drive shaft, a greater failure threshold is provided than if the drive shaft absorbed the moment. Further, even if the chuck mechanism or drive shaft 200 should fail, the drill pipe will still be supported by the support tube 232 and not fall.

Other elements of the raise drill apparatus are shown, such as an air tube 252 and rotary swivel 255 for transmitting fluid to the drill pipe and hydraulic lines for operating the motor 50 and thrust cylinders 22, but a detailed description will be omitted since these other elements are known to those skilled in the relevant art.

It should be understood that improvements and modifications can be made to the embodiments described above and that all such improvements and modifications are contemplated as falling within the scope of the appended claims.

The embodiments of the invention in which an exclusive property or privilege is claimed are defined as follows:

1. An improved drilling apparatus of the type which includes a ground engaging base, a torque transmitting apparatus for engaging and transmitting torque to drill pipe, and means mounted on the base for moving and guiding said torque transmitting apparatus back and forth along the drill pipe axis, wherein the improvement comprises:

(a) said moving and guiding means comprising two or more hydraulic cylinders connected at one end to the base of the drill apparatus and each having a movable piston rod projecting from its other end and away from the base;

(b) a guide tube surrounding and connected to the outer end of each piston rod, and each tube having an inner surface portion in overlapping sliding engagement with the outer surface portion of its associated cylinder; and (c) connecting means for rigidly connecting the torque transmitting apparatus between the guide tubes, said torque transmitting apparatus being the only direct connection between the guide tubes, and wherein the torque transmitting apparatus is guided back and forth along the drill pipe axis solely by the guide tubes moving along said cylinders.

2. The improvement of claim 1, wherein the base includes a pair of parallel skids, a work table rigidly connected between the skids, and the hydraulic cylinders are connected to the work table.

3. The improvement of claim 2, wherein each hydraulic cylinder includes a plate section sized and shaped to engage a mounting surface on the work table, the plate sections and mounting surfaces including aligned bolt holes for receiving connecting bolts.

4. The improvement of claim 3, wherein the engaging plate sections and mounting surfaces include cooperating slots oriented perpendicular to the axis of the skids, and a key insertable in each slot.

5. The apparatus of claim 1, and further including a friction-resistant bushing connected to the inner surface of the guide tubes, the guide tubes engaging the cylinders through the bushings.

6. The apparatus of claim 1, wherein the axes of the drill pipe and hydraulic cylinders are aligned parallel to each other.

7. The apparatus of claim 1, wherein the torque transmitting apparatus includes a motor, a plurality of gear reducers and a chuck mechanism for engaging the drill pipe, the motor being offset from the axis of the drill pipe.

8. The apparatus of claim 7, wherein the center of gravity of the apparatus being slightly offset from drill hole axis along a line perpendicular to the line intersecting the axes of the drill pipe and cylinders.

9. The apparatus of claim 1, wherein the connecting means includes a first pair of brackets connected to the guide tubes and facing each other, a second pair of brackets connected to the torque transmitting apparatus and sized and located to engage the first brackets, the first and second brackets including aligned bolt holes for receiving connecting bolts.

10. The apparatus of claim 9, wherein the first brackets include a horizontal ledge for receiving the bottom edge of the second brackets.

* * * * *